US005449302A

United States Patent [19]

Yarbrough et al.

[11] Patent Number: 5,449,302

[45] Date of Patent: Sep. 12, 1995

[54] HEAVY DUTY ELECTRICAL CONNECTION SYSTEM

[75] Inventors: Garrett S. Yarbrough, Chicago, Ill.; Richard C. Berry, Camillus, N.Y.; David K. Bedford, Phoenix, N.Y.; David C. Holloway, Liverpool, N.Y.

[73] Assignee: Cooper Industries, Inc., Houston, Tex.

[21] Appl. No.: 111,260

[22] Filed: Aug. 24, 1993

[51] Int. Cl.[6] ..... H01R 13/502

[52] U.S. Cl. ..... 439/680; 439/95; 439/695

[58] Field of Search ..... 439/92, 95, 97, 488, 439/491, 677, 680, 681, 695, 701

[56] References Cited

U.S. PATENT DOCUMENTS

| | | | |
|---|---|---|---|
| D. 336,070 | 6/1993 | Clark . | |
| 3,096,135 | 7/1963 | Feustel et al. . | |
| 3,097,905 | 7/1963 | Shearer et al. . | |
| 3,146,054 | 8/1964 | Shearer et al. . | |
| 3,614,711 | 10/1971 | Anderson et al. . | |
| 3,685,004 | 8/1972 | Kerr | 439/281 X |
| 3,771,108 | 11/1973 | Haffner et al. . | |
| 4,111,514 | 9/1978 | Brishka et al. . | |
| 4,159,862 | 7/1979 | Funck et al. . | |
| 4,229,064 | 10/1980 | Vetter et al. . | |
| 4,704,091 | 11/1987 | Owen et al. . | |
| 4,736,999 | 4/1988 | Marks et al. . | |
| 4,746,310 | 5/1988 | Morse et al. . | |
| 4,764,129 | 8/1988 | Jones et al. . | |
| 4,784,614 | 11/1988 | Sadigh-Behzadi . | |
| 4,820,193 | 4/1989 | Noorily . | |
| 4,820,204 | 4/1989 | Batty . | |
| 4,938,718 | 7/1990 | Guendel . | |
| 4,990,099 | 2/1991 | Marin et al. | 439/681 X |
| 5,017,162 | 5/1991 | Krehbiel et al. . | |
| 5,135,404 | 8/1992 | Clark . | |
| 5,167,527 | 12/1992 | Clark . | |
| 5,240,424 | 8/1993 | Honma et al. | 439/95 |

*Primary Examiner*—Khiem Nguyen

*Attorney, Agent, or Firm*—William B. Patterson; Eddie E. Scott

[57] ABSTRACT

The present invention serves to prevent severe injury, loss of life or damage to expensive equipment by creating a system in which the conductors of a plug and the conductors of a receptacle can only be arranged, one with respect to the other, in a unique rotational manner depending upon the intended electrical rating of the plug and receptacle. The resulting plug will mate only with a receptacle having that same configuration. A separate indexer is disposed between the plug body and the conductor assembly to the conductors in the plug to prevent entry of the plug into a differently indexed receptacle. A polarizer in the receptacle fixes the conductor assembly of the receptacle in the same manner as the plug, to allow the plug and receptacle to be mated together when the receptacle is wired for the same electrical rating as the equipment to be energized by the plug. Visual means of identifying the rotational attitude of conductors is provided whereby the electrical rating of the plug or receptacle can be easily identified. The visual means of identification may include color as well as printed coding information.

15 Claims, 4 Drawing Sheets

HEAVY DUTY ELECTRICAL CONNECTION SYSTEM

BACKGROUND OF THE INVENTION

The present invention relates to heavy duty electrical plugs and receptacles; more particularly, the invention relates to a system for mating plugs to receptacles, through the use of indexers and polarizers which fit within the plug and receptacle, to create a system of mated plugs and receptacles and thus ensure that a specific plug can only be mated to a receptacle having the same electrical rating.

Heavy duty electrical plugs, like those addressed by the invention, are disposed on high voltage cables and are connected to a receptacle to energize portable electrical equipment like portable welders. Each plug is equipped with a certain number of female conductors which are inserted into a corresponding number of mating male conductors in a receptacle. Typically, a receptacle of a specific electrical rating will be installed in a location as a need for equipment requiring that rating arises. The physical size of the plug and receptacle varies with amperage ratings of 30, 60 and 100 amps. A heavy duty plug arrangement of this type is disclosed in U.S. Pat. Nos. 5,167,527 and 5,135,404 assigned to the same entity as the present invention and those documents are incorporated by reference herein.

Within each amperage rating, numerous voltages and phases are possible for different plugs having the same number of conductors. For example, a 30 amp plug having three female conductors could be wired for a 120 V-single phase, 240 V-single phase, 480 V-single phase or 600 V-three phase use, by varying the voltage potential on each of the conductors. For example, a 120 V single phase configuration would have one conductor of 120 V potential, one conductor at 0 V potential, and one at ground potential. In the three-phase configuration, each conductor is energized to an equal, but 120° out of phase, voltage. Because a plug or receptacle with any of the foregoing voltage arrangements uses the same number of conductors, they appear identical to the user. However, insertion of a plug having one electrical rating into a receptacle having a different rating, can cause catastrophic results such as severe injury, loss of life or the destruction of expensive equipment.

Over the past 50 years, users of these plugs and receptacles have become accustomed to determining the rating of a plug by the rotational attitude of the conductors in relation to the location of identifying splines or notches on the plug and receptacle. Presently there are a number of schemes whereby conductors of a heavy duty plug are polarized or fixed at a certain rotational angle within the plug body to fit a receptacle having similarly polarized conductors to reduce the potential of components being mismatched to voltage supplies. In one such arrangement, different sets of matching plugs and receptacles are constructed with the conductors permanently polarized depending upon the electrical rating thereof and then labeled. The obvious disadvantage to this arrangement is that the parts of the plugs are not interchangeable and the industrial distributor must keep plugs and receptacles on hand for each possible wiring arrangement.

In another type of prior art arrangement, mating male and female conductor assemblies for different electrical ratings are available for use with a standard plug body whereby the polarization of the conductors in the plug is determined by the conductor assembly chosen. The conductor assembly in the receptacle is likewise interchangeable to provide a matching polarization for receiving the plug. However, those plugs and receptacles require different conductor assemblies for each different wiring possibility, which still results in a large inventory for the electrical distributor.

There is a need, therefore, for a plug and receptacle system using one set or type of conductors and parts whereby the conductors of the plug and conductors of the receptacle can be arranged or indexed in a certain configuration to guarantee that a plug wired for one electrical rating is not mated with a receptacle wired for a different electrical rating.

There is a further need for a heavy duty plug and receptacle, each of which can be arranged with conductors of a certain polarization without the need for changing a major part of the plug or receptacle.

There is yet a further need for a heavy duty plug and receptacle system in which the rotational attitude and the electrical rating of the conductors can be easily visually determined with minimal inspection of the plug or receptacle.

SUMMARY OF THE INVENTION

The present invention serves to prevent severe injury, loss of life or damage to expensive equipment by creating a system in which the conductors of a plug and the conductors of a receptacle can only be arranged, one with respect to the other, in a unique rotational manner depending upon the intended electrical rating of the plug and receptacle. The resulting plug will mate only with a receptacle having that same configuration, and thus there can be no mismatch of voltages or current phases which would result if a plug of one rating were installed in a receptacle of another rating.

The heavy duty electrical plug of the present invention is provided with a separate indexer which is disposed between the plug body and the conductor assembly to index the conductors in the plug and prevent entry of the plug into a differently indexed receptacle. The indexer fixes the conductors of the plug in a certain rotational position relative to the plug body depending upon the desired electrical rating of the plug. A polarizer in the receptacle fixes the conductor assembly of the receptacle in the same manner as the plug, to allow the plug and receptacle to be mated together when the receptacle is wired for the same electrical rating as the equipment to be energized by the plug.

Different standardizable matching sets of indexers and polarizers are provided for different electrical rating requirements, each fixing the conductors of the plug and of the receptacle in a slightly different rotational position. Additionally, the indexers and polarizers of the present invention include safety features preventing their improper insertion into a plug or receptacle. When the indexer in the plug and polarizer in the receptacle do not match, a plug cannot be mated to the receptacle and thus the mating of plugs and receptacles having different electrical ratings is avoided. Also, since the same bodies and conductor assemblies can be used for any electrical rating with a certain amperage, the electrical distributor need only stock a variety of different indexers and polarizers to use with the standard plug and receptacle bodies to fulfill all needs.

Visual means of identifying the rotational attitude of conductors is provided whereby the electrical rating of the plug or receptacle can be easily identified. The visual means of identification may include color as well as printed coding information.

DESCRIPTION OF A PREFERRED EMBODIMENT

The Plug

Figure 1:
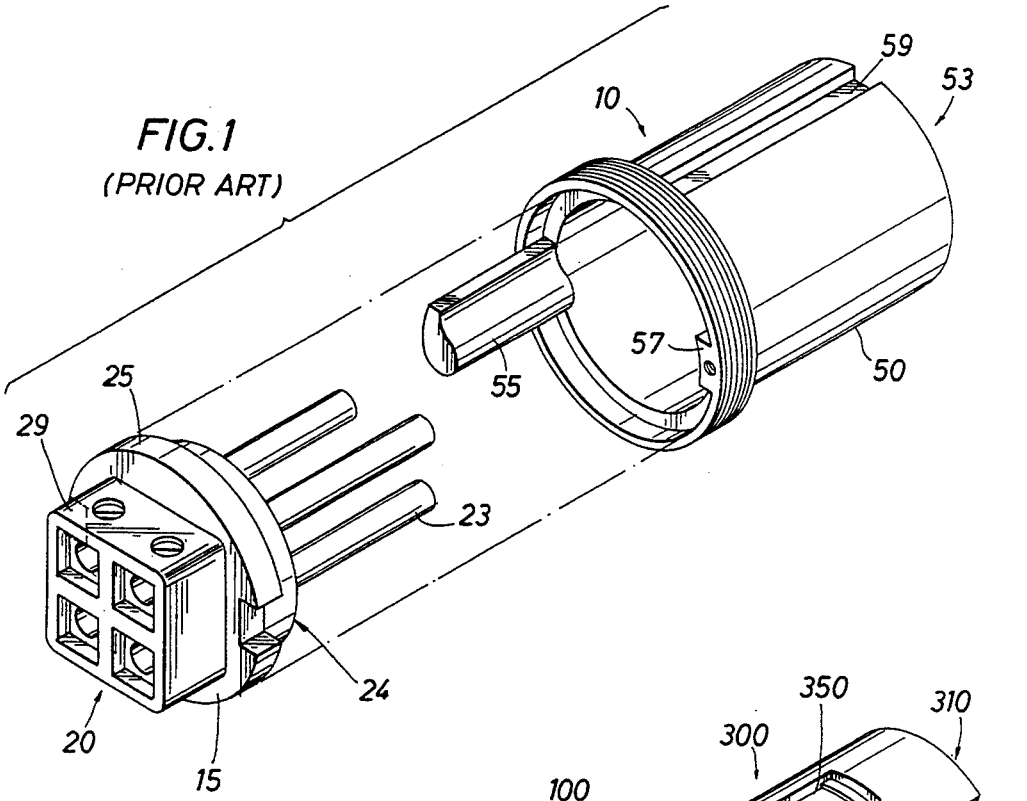
FIG.1 (PRIOR ART)
FIG. 1 is an exploded view of a prior art electrical plug.

FIG. 1 is an exploded view of a prior art heavy duty electrical plug assembly 10. Depicted in the figure is a conductor assembly 15 which houses the conductive elements of the plug and a sleeve 50 which receives conductor assembly 15 therein. Conductor assembly 15 includes means for connection to electrical wires at a first end 20 thereof, and has a plurality of female conductors 23 extending from a second end 24 thereof which are received within sleeve 50. Sleeve 50 engages over a receptacle {not shown). Conductor assembly 15 also has a substantially circular perimeter 25 having two notches 28, 29 formed therein.

Sleeve 50 is a substantially tubular member, having open first 52 and second 53 ends. Sleeve 50 is keyed to be received in a specific rotational alignment in receptacle by groove 59 formed longitudinally along the exterior of sleeve 50. Sleeve 50 includes a grounding post 55 extending from first end 52, and a boss 57 received on first end 52. Post 55 and boss 57 engage notches 28, 29 in conductor assembly 15, thereby fixing the conductor assembly 15 in a certain rotational attitude with respect to groove 59.

When conductor assembly is assembled on sleeve 50, the second end 24 of conductor assembly 15 is held within sleeve 50. A cover (not shown) covers the first end 20 of conductor assembly 15 and is threaded onto sleeve 50 which has external threads 58 at its first end 52. As stated, the prior art arrangement of FIG. 1 permanently fixes the male conductors 23 of conductor assembly 15 in a certain rotational attitude with respect to sleeve 50 for a specific voltage and amperage use. A different sleeve 50 or conductor assembly 15 are provided for each different electrical rating.

Figure 2:
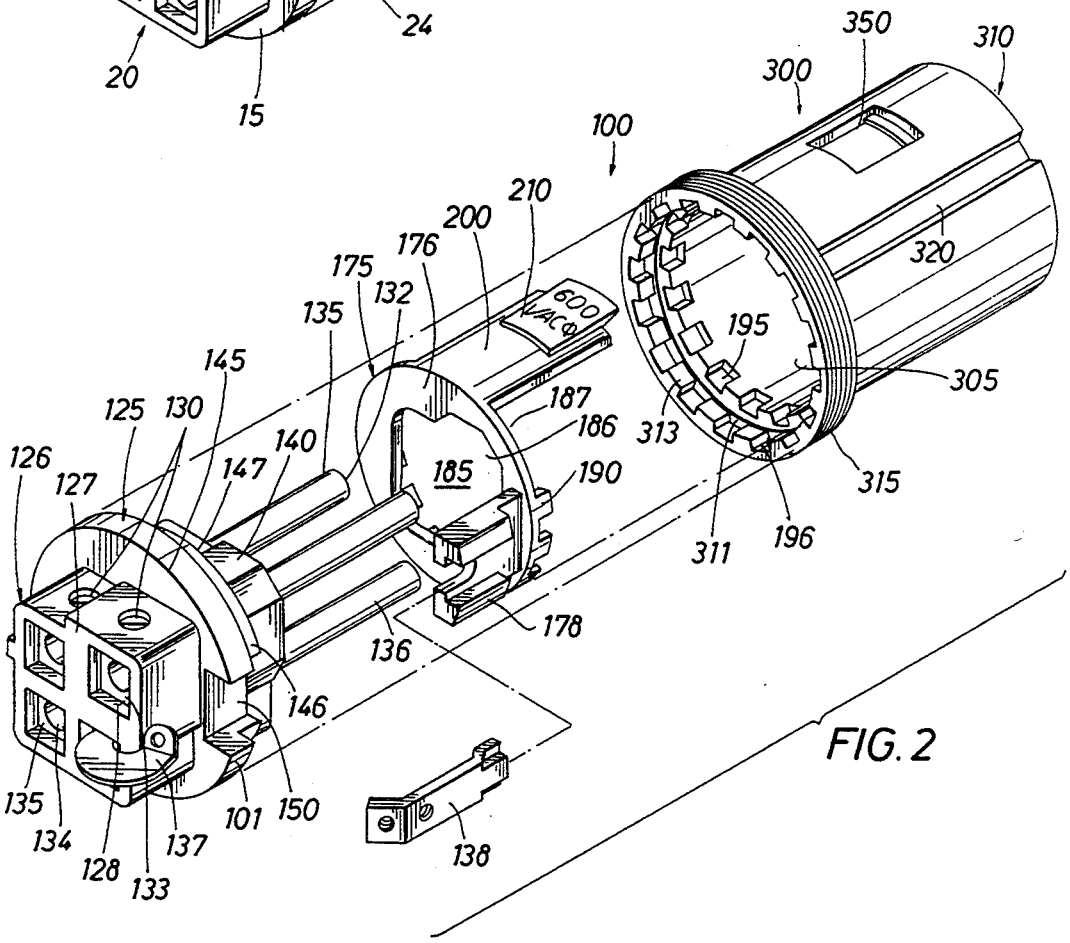
FIG. 2 is an exploded view of the heavy duty electrical plug that is the subject of the present invention.
Figure 3:
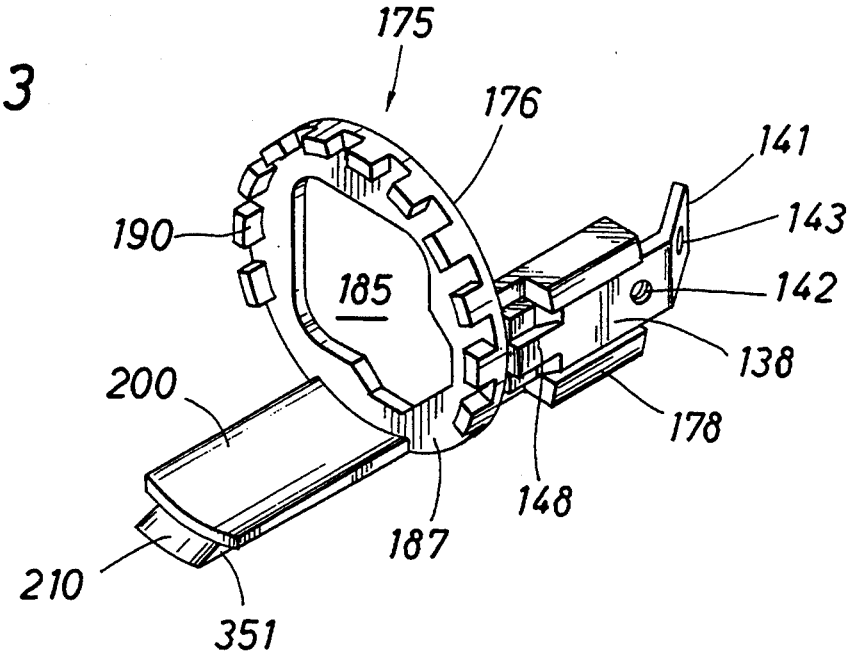
FIG. 3 is a perspective view of the indexer and grounding clip of FIG. 2.
Figure 4:
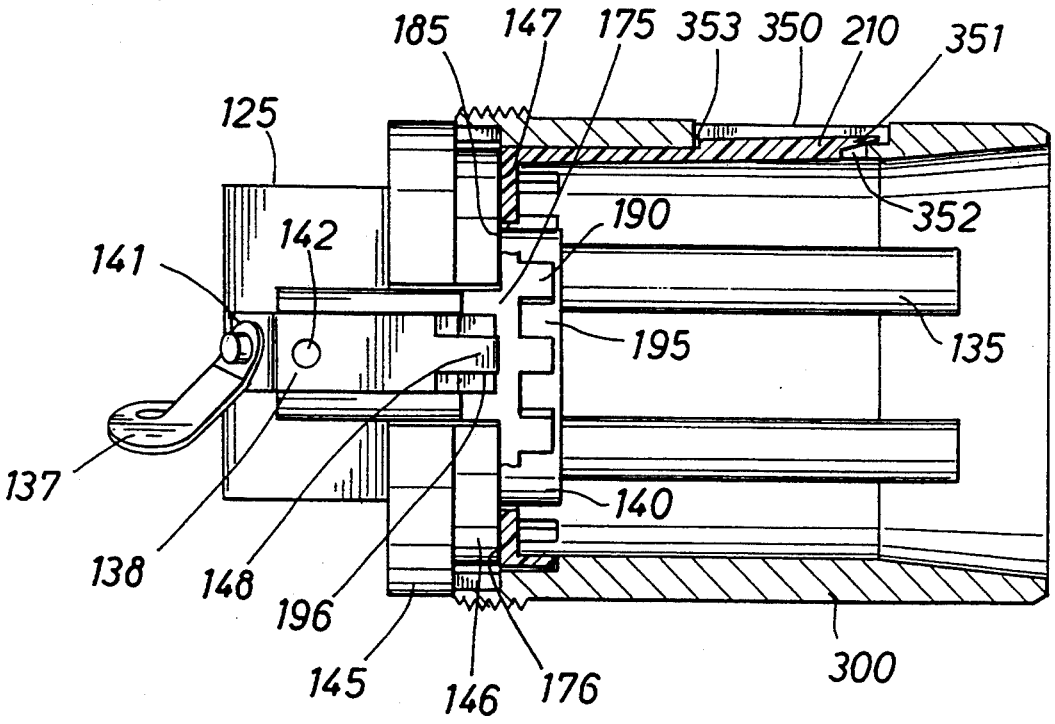
FIG. 4 is a section view of the plug of the present invention showing the mating portions of the plug.

Referring now to FIGS. 2 to 4, the heavy duty plug portion 100 of the heavy duty electrical connection system of present invention is depicted. Included is a conductor assembly 125, an indexer 175 and a sleeve 300. Conductor assembly 125 receives indexer 175 thereon, and conductor assembly 125 with indexer thereon is received in sleeve 300, and a cover is engaged, to form plug 100.

The conductor assembly 125 includes an insulator portion 126 with means for connection to wires coming from a power source into plug assembly 100 (wires not shown), a generally circular body portion 101 and a second end 140 disposed as an extension of body portion opposite insulator 126. Body portion 101 includes a first major diameter portion 145, and a second minor diameter portion 146, having slot 150 therethrough. In the preferred embodiment, the insulator portion 126 is constructed of a fiberglass reinforced polyester and includes openings 128 which receive one end of conductors 135 therein. Each opening is separated by a thickened wall 127 to prevent electrical creeping between conductors 135 and to provide strength. Each conductor 135 has a cylindrically-shaped first end 132 and a rectangular-shaped second end 133 which includes a circular opening 134 therein. Conductors 135 are enlarged into a rectangle to fit snugly within openings 128 in insulator portion 126, and are thereby prevented from rotating within the insulator portion 126. Individual wires from a cable can be inserted through opening 128 in insulator 126 and thus into circular opening 134 in conductor 135. Thereafter, compression screws 130 are tightened down upon each wire to form a mechanical and electrical connection between each wire and corresponding conductor 135.

One of the conductors 136 is configured as a ground conductor and is equipped with a ground strap 137. Ground strap 137 is designed to be connected with ground clip 138 to provide grounding between conductor assembly 125 and sleeve 300, as will be discussed further herein. Conductors 135 are female conductors typically made of a copper alloy and designed to mate with corresponding male conductors in a receptacle in a pin-and-sleeve manner.

In the depicted embodiment, the conductor assembly 125 includes four female conductors 135, only three of which are visible in FIG. 2. Each conductor is a tubular member with an inner, female pin receiving bore therein. However, the plug 100 could utilize male conductors designed to mate with female conductors in a receptacle. Furthermore, the invention can be utilized with plugs having three and five conductors and is not limited to use with any certain number, shape or configuration of conductors.

Those of ordinary skill in the art will notice that the first departure from the prior art device shown in FIG. 1 is the presence of an indexer 175 disposed between the conductor assembly 125 and the sleeve 300. In the preferred embodiment, indexer 175 is made of a thermoplastic polyester and is substantially circular having a first side 176 and a second side 187, with a post 178 extending substantially perpendicular from the indexer. The center of indexer 175 includes aperture 185 therethrough, which is dimensioned to fit over the second end 140 of conductor assembly 125. As depicted in FIG. 3, aperture 185 is generally square in shape with an enlarged corner 186. The shape of aperture 185 and the mating shape of second end 140 of the conductor assembly ensures that the indexer will fit over the end of the conductor assembly in a specific alignment, thus ensuring the required rotational attitude of the conductors 135 with respect to sleeve 300. A number of equally spaced indexing teeth 190 extend outward partially around the perimeter of the second side 187 of indexer 175. Indexer 175 also includes arm 200 and tab 210 extending substantially perpendicular from the second side 187. The tab 210 provides printed and color-coded information about the electrical rating of the plug.

Referring now to FIGS. 2 and 4, sleeve 300 is annular in shape having an open first 305 and second 310 ends. Sleeve 300 has an enlarged, threaded outer perimeter 315 at its first end 305, and a polarizing groove 320 extending longitudinally along the outer portion of sleeve 300 from threaded outer perimeter 315 to first end 310. Polarizing groove 320 fixes the rotational attitude of the plug 300 with respect to a receptacle. The interior portion of sleeve 300 adjacent first end 305 includes a first shoulder 311 having a plurality of equally spaced indexing notches 195 extending around the inner circumference of sleeve 300 and designed to engage the indexing teeth 190 formed in the second side 187 of indexer 175. A plurality of grounding notches 196 formed in a second shoulder 313 cooperate with the grounding clip 138 to ground the conductor assembly 125 to the sleeve 300. In the preferred embodiment, the notches 195 and teeth 190 on indexer 175 are rectangular in shape. However, it will be understood that the notches 195 could be V-shaped or any other shape so long as they engage one another to prevent movement of one part of the plug with respect to another. While the interior of sleeve 300 is circular in the preferred embodiment, it will be understood that the invention could be practiced with a sleeve having a many-sided interior so long as the interior serves to retain the indexer in a variety of rotational position. Sleeve 300 further includes a rectangular-shaped window opening 350 in its side which receives tab 210 and allows the tab to be visible when plug 100 is assembled.

Referring now to FIG. 3, the assembly of the indexing ring 175 and grounding clip 138 is shown. The grounding clip 138 is inserted and held within grounding post 178 on ring 175, which is slotted to allow the clip 138 to be held in a recessed position therein. Grounding clip 138 includes a tooth 148 at a first end and an angled portion 141 at a second end. Tooth 148 is received within one of grounding notches 196 in sleeve 300. Additionally, the grounding clip 138 is equipped with two fastening holes 142 and 143. Hole 143 allows connection of the grounding strip 137 to grounding clip 138 (shown in FIG. 4) and hole 142 is utilized with a set screw (not shown) to hold the assembled plug together.

FIG. 4 depicts the interconnection of the conductor assembly 125, indexer 175 and sleeve 300 when the plug 100 is assembled. The second end 140 of conductor assembly 125 is extended through the aperture 185 of indexer 175 and the first side 176 of indexer 175 rests against the front surface 147 of minor diameter portion 146 of the conductor assembly. Indexing teeth 190 of indexer 175 engage indexing grooves 195 in the interior of sleeve 300. Tooth 148 of grounding clip 138 engages within a grounding groove 196 of sleeve 300.

Rotation of the conductors 135 with respect to the sleeve 300 is prevented by the interaction of indexer 175 with the conductor assembly 125 and with the sleeve 300. In the assembled plug, rotation is prevented between the indexer 175 and the conductor assembly 125 through the mating of aperture 185 of indexer 175 over the second end 140 of conductor assembly 125. Additionally, rotation is prevented between the indexer 175 and the conductor assembly 125 by the grounding post 178 of indexer 175 which is held within notch 150 of the conductor assembly 125. Rotation between the indexer 175 and sleeve 300 is prevented by the engagement of indexing teeth 190 with indexing grooves 195. Additionally, rotation is prevented by the engagement of the tooth 148 of grounding clip 138 with grounding grooves 196 in the sleeve 300.

FIG. 4 also depicts the relation between the arm 200 and tab 210 of the indexer 175 and the window opening 350 of sleeve 300 and the alignment of arm 200 with respect to polarizing groove 320 on sleeve 300. When the plug is assembled, the tab 210 is received within window 350 of sleeve 300 and is visible therethrough. Tab 210 is equipped with a ramped portion 351 which, upon insertion of the indexer 175 into the sleeve 300, engages a matting ramped portion 352 of window 350 to hold tab 210 at the opening of window opening 350. Additionally, a first edge 353 of tab 210 snaps into window opening 350 and prevents indexer 175 from falling out of sleeve 300 as the plug 100 is assembled. Tab 210 includes printed information regarding the electrical rating of the plug 100. The information can regard but is not limited to voltage, AC/DC current type, phase information and catalogue number. Also, the tab 210 can be color-coded whereby a certain color refers to a certain electrical rating. For example, in the preferred embodiment, a blue tab would be indicative of a plug wired for 240 VAC, single-phase use. Window 350 is disposed through sleeve 300 in a specific location with respect to groove 320 for each rating of plug 100. The alignment of aperture 185 with respect to polarizing arm 200 may be modified to present a unique alignment of conductors 135 with respect to polarizing groove 320 for each rating.

In assembling the plug of the present invention, the indexer 175 is placed within sleeve 300 thereby engaging the teeth of the indexer 190 and the sleeve 300 and allowing the tab 210 to be visible through window opening 350. Thereafter, the second end 140 of conductor assembly 125 is inserted into the indexer/sleeve until the first side 176 of the indexer 175 rests against the second end 140 of the conductor assembly 125 and the post 178 of the indexer 175 is seated in the notch 150.

In the preferred embodiment, the indexer 175 is manufactured with the arm 200 and tab 210 location determined by the rotational attitude required for a particular wiring scheme. By choosing a different indexer 175 with the arm 200 and tab 210 in a different location, the conductors 135 can be set in a different attitude with respect to groove 320 for a different voltage and wiring scheme. Since the indexer 175 can only be placed in the sleeve 300 in the manner which allows the tab 200 to be visible through the window 350 opening, improper insertion of the indexer 175 into the sleeve 300 is avoided.

The indexer 175 of the present invention allows the plug assembly 100 to be assembled with the conductors 135 at any rotational attitude depending upon the wiring arrangement required, by simply changing the location of enlarged corner 186 of aperture 185 with respect to arm 200 and post 178. Because the sleeve is equipped with grounding notches 196, the present invention allows proper grounding between the conductor assembly 125 and the sleeve 300 regardless of the attitude of the conductors 135. As discussed below, the receptacle to which the plug assembly 100 is mated can be fitted with a polarizer providing male conductors set in a matching rotational attitude.

The Receptacle

Referring to FIGS. 5 to 8, the receptacle portion 400 to receive plug 100 of the present invention includes a housing 510, a male conductor assembly 550 and a polarizer 575. The male conductors 552 are received within male conductor assembly 550 (FIGS. 5 and 6) and are constructed and arranged to mate with the female conductors 135 of plug 100 in a pin and sleeve-type manner.

Figure 6:
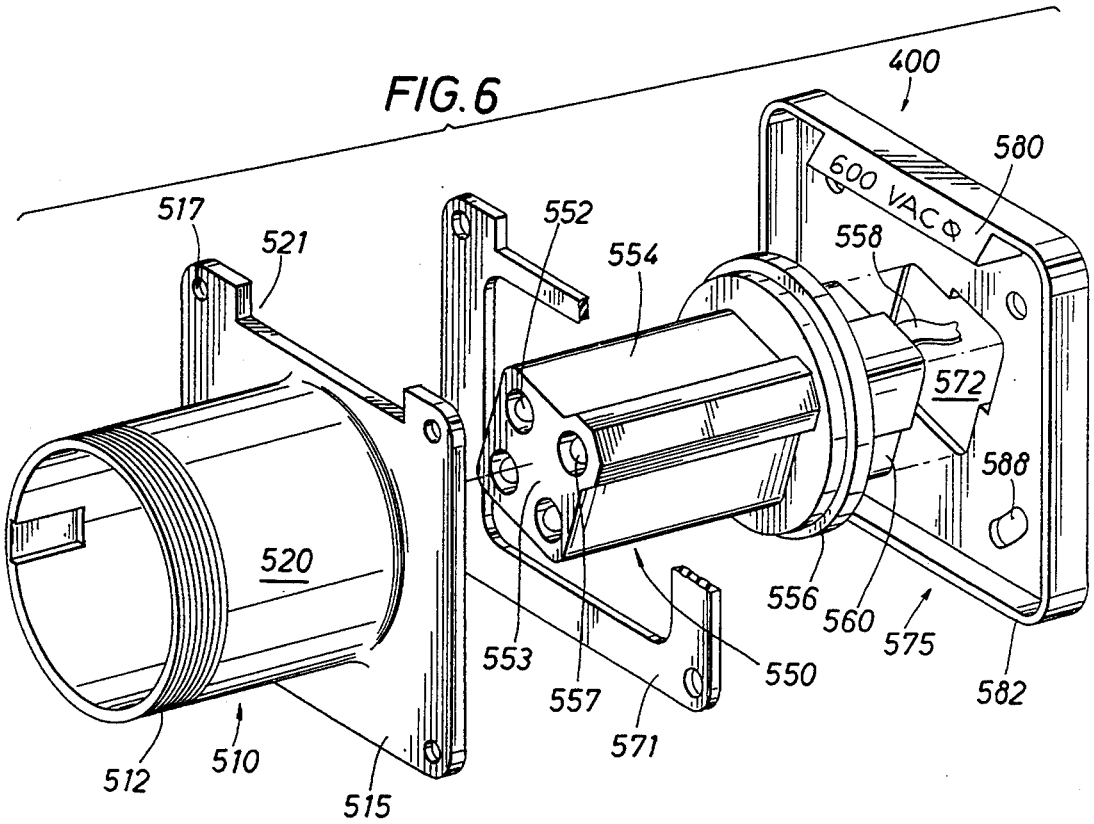
FIG. 6 is an exploded view of the receptacle of FIG. 5.
Figure 7:
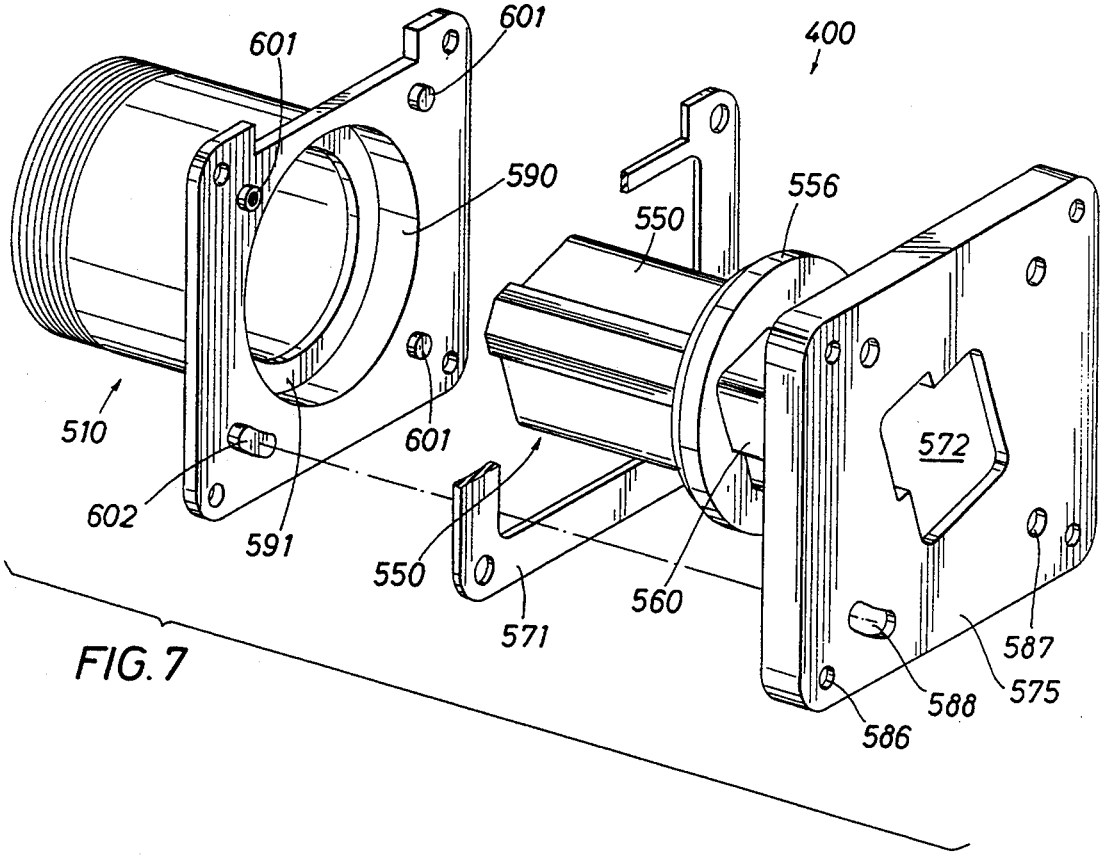
FIG. 7 is an exploded view of the receptacle of FIG. 5 from the rear.

FIGS. 6 and 7 are exploded views showing the individual parts of the receptacle 400. Housing 510 is typically made of cast aluminum and includes a base portion 515 and a cylindrical tubular portion 520 projecting therefrom which is threaded at a first end 512 for attachment to a plug 100 via a gland nut (not shown). In the preferred embodiment, the base portion 515 of housing 510 includes attachment holes 517 to allow the housing 510 to be attached to a wall or other surface (not shown). Base portion 515 also includes opening 521, which receives an angled label portion 580 of polarizer 575, to allow angled label portion to be visible when the receptacle is assembled. An optional gasket 571 is typically configured from a silicon rubber, self-adhesive gasket material, is located between the housing 510 and the polarizer 575 in the assembled receptacle.

Male conductor assembly 550 includes four recessed, male conductors 552 which are a housed in body portion 554. Body 554 extends from the first side of a substantially circular portion 556, and an irregularly-shaped second end 560 extends from a second side of the circular portion 560. Like the female conductor assembly 125 of the plug 100, the male conductor assembly 550 is made of fiberglass reinforced polyester with thickened walls 553 to provide structural strength and prevent electrical creeping between conductors 552.

Figure 5:
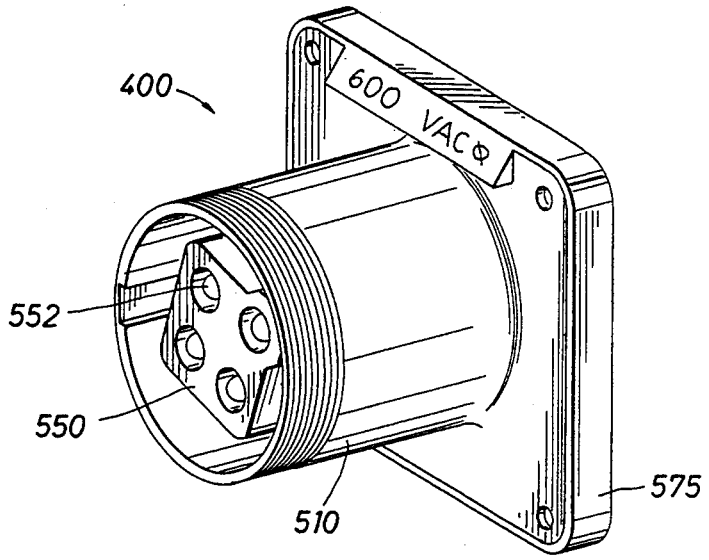
FIG. 5 is a perspective view of the receptacle of the present invention.

The polarizer 575 is 4-sided in its preferred embodiment with raised edges 582 whereby the base portion 515 of housing 510 fits within the polarizer 575 when the receptacle 400 is assembled (FIG. 5). Polarizer 575 includes a polarizing cut-out 572 therethrough which is configured to receive the irregularly-shaped second end 560 of conductor assembly 550 fits therein in a specific alignment when the receptacle 400 is assembled, thereby preventing rotational movement of the conductor assembly 550 within the polarizer 575 and establishing the location of male conductors 552 with respect to label portion 580.

The receptacle in FIG. 6 utilizes four conductors. Therefore, the shape of the irregularly-shaped second end 560 forms basically a square with an enlarged corner much like the second end 140 of male conductor assembly 125 of plug 100. It will be understood however, that the second end 560 of conductor assembly 550 could form a variety of shapes limited only by the number of conductors 552 used in the receptacle and the need for the shape to be somewhat irregular to prevent rotation of the conductor assembly 550 within the polarizer 575.

Figure 8:
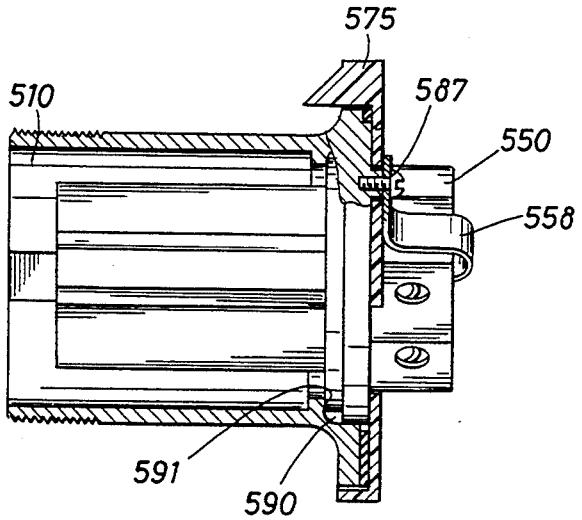
FIG. 8 is a section view of the receptacle of FIG. 5 showing the mating portions of the receptacle.

FIG. 7 depicts the receptacle as viewed from the rear. Visible in the Figure is an interior diametrical surface 590 and a circular shelf area 591 which forms the inward terminus of surface 590 inward housing 510. Also visible in FIG. 7 are mounting holes 586 in polarizer 575 which cooperate with attachment holes 517 in housing 510 to mount receptacle to a wall or other surface. Polarizer 575 is equipped with three circular grounding holes 587 and one slot-shaped grounding hole 588, which are utilized to achieve electrical grounding between the conductor assembly 550 and housing 510. As can be seen in FIGS. 6 and 8, conductor assembly 550 includes one ground conductor 557 which has a ground strap 558 attached thereto at its second end. Ground strap 558 protrudes from the second end 560 of conductor assembly 550.

FIG. 8 is a sectional view showing how the polarizer 575, conductor assembly 550 and housing 510 fit together in the assembled receptacle. In the preferred embodiment, the receptacle is assembled by placing the conductor assembly 550 into the cut-out portion 572 of the polarizer 575 which fixes the rotational angle of the conductors 552 with respect to the polarizer 575. Thereafter, the housing is placed over the conductors and fits within the polarizer in a manner whereby the angled label portion 580 of polarizer 575 is visible through opening 521 in housing 510. Grounding strap 558 is then grounded to the housing 510 through grounding boss 587.

To ensure the polarization arrangement is not thwarted, the housing 510 can only be placed over the polarizer 575 in the manner that allows the angled label portion 580 of the polarizer 575 to extend into the cut-out portion 521 of the housing 510. As additional means of ensuring that the housing 510 is placed over the polarizer 575 in the correct manner, the underside of housing 510 includes three circular, threaded bosses 601 and one slot-shaped boss 602. The bosses are designed to fit through the grounding holes with the slot shaped boss 602 necessarily mated with the slot shaped grounding hole 588. This additional safety measure further ensures the desired rotational attitude of the conductors.

Angled label portion 580 of polarizer 575, like tab 210 of indexer 175 in plug 100, includes printed information about the electrical rating of the receptacle. The information includes voltage, AC/DC current type and phase information. Additionally, the label 580 can be colored to designate a particular rating.

The heavy duty electrical connection system of the present invention provides a simple way to change the rotational attitude of conductors without having to change major portions of the plug and receptacle. Additionally, the invention provides a simple, visual technique for identifying the wiring arrangement of a heavy duty electrical plug or a receptacle, thereby solving the problem created by plugs and receptacles that look identical but have different wiring schemes.

The heavy duty electrical plug and receptacle system of the present invention has been described according to a preferred embodiment. However, it will be understood that the embodiments of the invention could be different and still fall within the purview of the present invention. For example, the plug sleeve and the receptacle housing need not be cylindrical but could be rectangular or square or even oval in shape. Such changes are within the scope of the present invention.

We claim:

1. A heavy duty electrical plug, said plug comprising:

a female conductor assembly for insertion into a receptacle, said female conductor assembly including:

a first end having a plurality of female conductors extending therefrom and having a substantially irregular shape;

a second end having means for electrical and mechanical connection to a plurality of wires;

a sleeve having a substantially circular interior for housing said female conductors and having a first inwardly facing shoulder in the interior thereof;

a substantially circular indexer, said indexer dimensioned to fit within said sleeve between said sleeve and said female conductor assembly, said indexer held within said sleeve by said first inwardly facing shoulder and;

means to prevent rotational movement between said conductor assembly and said sleeve including:

a plurality of indexing teeth formed around a second side of said indexer and a plurality indexing notches formed in said first inwardly facing shoulder in said interior of said sleeve, said indexing teeth adapted to engage said indexing notches upon insertion of said indexer into said sleeve thereby preventing rotation of said indexer with respect to said sleeve and, a substantially irregular shaped aperture in said indexer, the interior of said aperture slightly larger than said substantially irregular-shaped first end of said female conductor assembly, whereby said first end of said female conductor assembly extends through said aperture thereby preventing rotation of said indexer with respect to said conductor assembly, whereby, when said plug is assembled, said plurality of female conductors are held in a first rotational attitude with respect to said sleeve.

2. The heavy duty electrical plug defined in claim 1, whereby said means to prevent rotation between said conductor assembly and said sleeve further includes:

at least one notch in the outside diameter of said female conductor assembly, said at least one notch constructed and arranged to hold at least one protrusion extending from a first side of said indexer.

3. The heavy duty plug assembly defined in claim 2, further including a ground clip, said ground clip extending between the providing electrical grounding between said conductor assembly and said sleeve.

4. The heavy duty electrical plug defined in claim 3, whereby said at least one protrusion extending from said first side of said indexer includes a slot, said slot constructed and arranged to house said grounding clip.

5. The heavy duty plug assembly defined in claim 4, whereby said interior of said sleeve includes a second inwardly facing shoulder, said second inwardly facing shoulder including a plurality of ground notches formed therein.

6. The heavy duty plug assembly defined in claim 5, whereby said ground clip includes at least one grounding tooth formed at a first end thereof, said at least one grounding tooth constructed and arranged to engaged any of said plurality of grounding notches formed in said second inwardly facing shoulder of said sleeve.

7. The heavy duty plug assembly defined in claim 6, whereby one of said plurality of conductors is a ground conductor, said ground conductor having means for electrical and mechanical attachment to said grounding clip.

8. The heavy duty electrical plug defined in claim 7, including visual means for identification of said first rotational attitude of said female conductors, said visual means operable when said plug is assembled.

9. The heavy duty electrical plug defined in claim 8, whereby said visual means for identity of said first rotational attitude includes:

a window opening formed in said sleeve;

an arm and tab extending from said second side of said indexer, said tab constructed and attached to become visible through said window opening when said plug is assembled.

10. The heavy duty electrical plug defined in claim 9, whereby said indexer can only be inserted into said sleeve in a manner allowing said tab to become visible through said window opening when said plug is assembled.

11. The heavy duty electrical plug defined in claim 10, whereby said tab includes a first ramped portion at a first end and said window opening includes a mating ramped portion at a first end whereby said first and mating ramped portions cooperate to retain said tab in said window opening.

12. The heavy duty electrical plug defined in claim 11, whereby said tab includes a step formed at a second end, said step constructed and arranged to cooperate with said window opening to retain said indexer in said sleeve.

13. The heavy duty electrical plug defined in claim 12, whereby said tab includes printed information identifying the electrical rating of said plug.

14. The heavy duty electrical plug defined in claim 13, whereby said tab includes a color code to identify said electrical rating of said plug.

15. A heavy duty electrical plug, said plug comprising:

a female conductor assembly for insertion into a receptacle, said female conductor assembly including:

a first end having a plurality of female conductors extending therefrom and having a substantially irregular shape;

a second end having means for electrical and mechanical connection to a plurality of wires;

a sleeve having a substantially circular interior for housing said female conductors and having a first inwardly facing shoulder in the interior thereof;

a substantially circular indexer, said indexer dimensioned to fit within said sleeve between said sleeve and said female conductor assembly, said indexer held within said sleeve by said first inwardly facing shoulder; and means to prevent rotational movement between said conductor assembly and said sleeve including:

a plurality of indexing teeth formed around a second side of said indexer and a plurality indexing notches formed in said first inwardly facing shoulder in said interior of said sleeve, said indexing teeth adapted to engage said indexing notches upon insertion of said indexer into said sleeve thereby preventing rotation of said indexer with respect to said sleeve;

a substantially irregular shaped aperture in said indexer, the interior of said aperture slightly larger than said substantially irregular-shaped first end of said female conductor assembly, whereby said first end of said female conductor assembly extends through said aperture thereby preventing rotation of said indexer with respect to said conductor assembly; and visual means for identification of said first rotational attitude of said female conductors, said visual means including:

a window opening formed in said sleeve;

an arm and tab extending from said second side of said indexer, said tab constructed and attached to become visible through said window opening when said plug is assembled;

whereby said indexer can only be inserted into said sleeve in a manner allowing said tab to become visible through said window opening when said plug is assembled.

* * * * *